US006134819A

United States Patent [19]

McClain et al.

[11] Patent Number: 6,134,819

[45] Date of Patent: Oct. 24, 2000

[54] PORTABLE ILLUMINATED TRAFFIC SIGNAL DEVICE

[76] Inventors: Ronald G. McClain, R. R. 1, Box 192B; Rodney B. McClain, R. R. 1, Box 192A, both of Findlay, Ill. 62534

[21] Appl. No.: 09/022,313

[22] Filed: Feb. 11, 1998

[51] Int. Cl.[7] ..... G09F 21/02; G09F 7/00

[52] U.S. Cl. ..... 40/586; 40/492; 40/612; 248/219.2; 248/221.11; 403/116

[58] Field of Search ..... 40/586, 612, 607, 40/492, 442; 340/908, 321, 473; 248/219.2, 221.11, 222.52; 403/113, 116, 349

[56] References Cited

U.S. PATENT DOCUMENTS

| | | | |
|---|---|---|---|
| 1,459,856 | 6/1923 | Otte | 40/607 X |
| 3,892,081 | 7/1975 | Goral | 40/612 X |
| 4,042,919 | 8/1977 | Patty | 340/321 |
| 4,601,120 | 7/1986 | Levin | 40/317 |
| 4,751,622 | 6/1988 | Williams . | |
| 4,777,751 | 10/1988 | Pasquale | 40/612 |
| 4,827,245 | 5/1989 | Lipman . | |
| 4,884,017 | 11/1989 | Williams . | |
| 5,023,607 | 6/1991 | Staten | 40/612 X |
| 5,034,847 | 7/1991 | Brain . | |
| 5,186,197 | 2/1993 | Lavine | 403/349 X |
| 5,446,440 | 8/1995 | Gleason et al. . | |
| 5,502,910 | 4/1996 | Lucchesi | 40/606 |
| 5,694,110 | 12/1997 | Clifford | 40/586 X |
| 5,755,051 | 5/1998 | Zumbuhl | 40/586 |

*Primary Examiner*—Brian K. Green
*Attorney, Agent, or Firm*—Dale J. Ream

[57] ABSTRACT

A traffic signaling device includes a strobe light directed upon a portable traffic sign for alerting distant motorists of an upcoming traffic condition and for enhancing readability of the traffic sign. The signaling device includes a rotatable sign assembly releasably attached to a primary shaft suitable for holding by a road construction worker. The sign assembly includes a handle which cooperates with a channel within the primary shaft whereby the sign can be rotated to discrete, locked positions without repositioning the primary shaft or strobe light. Thus, either side of a sign may be displayed to oncoming traffic while a worker's eyes are always shielded from the strobe light.

17 Claims, 6 Drawing Sheets

PORTABLE ILLUMINATED TRAFFIC SIGNAL DEVICE

BACKGROUND OF THE INVENTION

This invention relates to a traffic signal device and, more particularly, to a portable device which is easily rotatable to discrete positions for presenting an illuminated sign which alerts motorists to a traffic condition.

It is known that highway and bridge construction or repair often requires the flow of traffic to be slowed, stopped, or rerouted. This type of traffic control is often accomplished through placement of traffic signs along the roadway and/or by a flagman standing near an active lane of traffic while holding a portable "slow" or "stop" sign. The flagman must maintain this unavoidably unsafe position in order to alert motorists to the presence of more workers ahead.

The danger to flagmen and construction crews is greater during nighttime hours when visibility is diminished. Unfortunately, road crews frequently conduct operations requiring traffic stoppage or diversion at night to take advantage of generally lighter traffic or cooler temperatures. Reflective vests worn by construction workers or reflective road signs provide only marginal utility as they become visible to a motorist only when the automobile lights shine directly upon the reflective surface and are directly reflected back to the motorist.

It is therefore desirable to have a portable traffic signal device which promotes the safety of both motorists and road construction workers by alerting distant motorists to an upcoming traffic condition and by aiding motorists in reading the traffic sign itself.

SUMMARY OF THE INVENTION

In response thereto, we have invented a traffic signaling device having a single pole for receiving and holding a traffic sign. The sign is rotatable 180° to discrete positions within the pole to facilitate frequently alternating traffic flow instructions such as "slow" and "stop", the sign being lockable at each discrete position within the pole. A strobe light is attached to the pole on the side nearest oncoming traffic with the light being focused directly upon the traffic sign affixed atop the pole. The traffic sign is rotated 180° without making contact with the strobe light unit.

Accordingly, a flagman may carry the signaling device to a desired location, insert and/or rotate the traffic sign to display and lock at discrete positions the desired instruction to oncoming traffic, and activate the strobe light. Distant oncoming motorists, therefore, will be alerted by the strobe light that a traffic condition lies ahead and will be aided in reading the traffic sign by the light's illumination of the sign.

It is therefore a general object of this invention to provide a traffic signaling device for enhancing the safety of workers and motorists in road construction/repair zones.

Another object of this invention is to provide a traffic signaling device, as aforesaid, having a shaft for receiving an easily attachable/detachable traffic sign in relative rotation therebetween.

Still another object of this invention is to provide a traffic signaling device, as aforesaid, which allows a traffic sign to be rotated 180° without repositioning the device itself, the traffic sign being locked into each position.

A further object of this invention is to provide a traffic signaling device, as aforesaid, having a detachable strobe light which is visible to motorists at a substantial distance.

A still further object of this invention is to provide a traffic signaling device, as aforesaid, having a strobe light which directly illuminates the face of the traffic sign.

Yet another object of this invention is to provide a traffic signaling device, as aforesaid, which is lightweight, portable, and therefore suitable to be held by a road construction worker.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
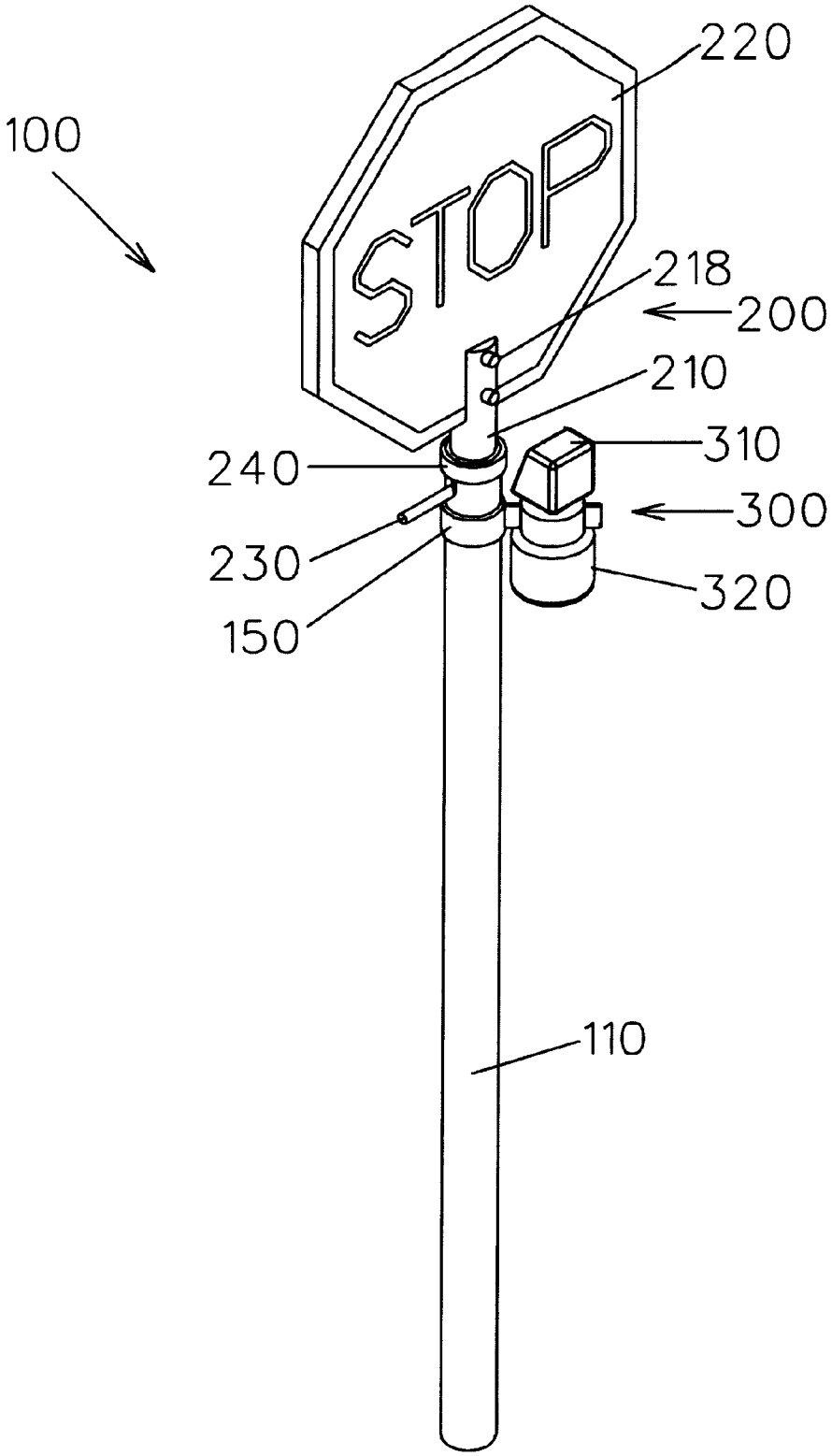
FIG. 1 is a perspective view of the traffic signaling device.
Figure 2:
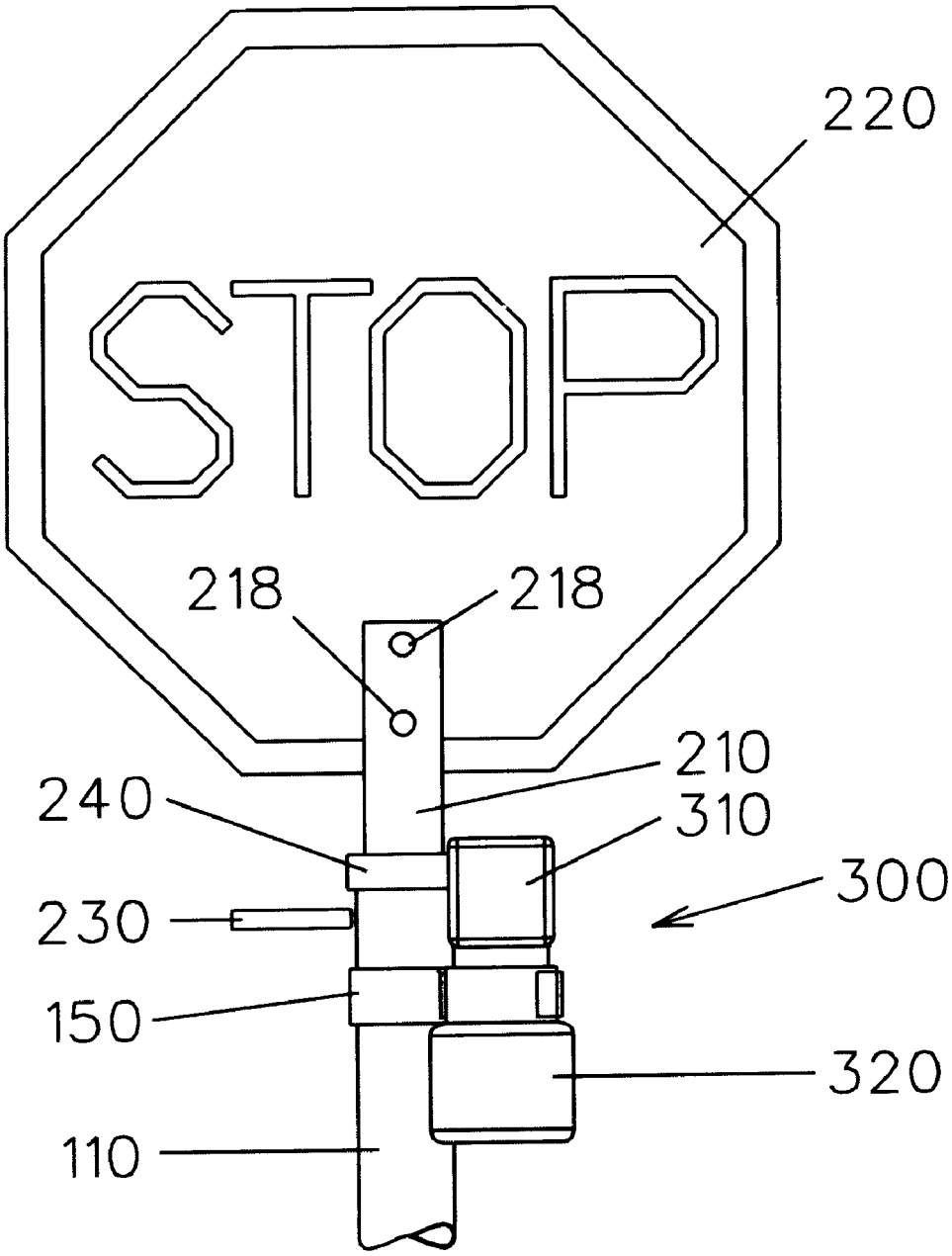
FIG. 2 is a front fragmentary view of the traffic signaling device showing the sign assembly and strobe light attached thereto.

Turning more particularly to the drawings, FIGS. 1 and 2 show the traffic signaling device 100 generally comprising a sign assembly 200 insertably attached to a primary elongated cylindrical hollow shaft 110, said primary shaft 110 preferably made of lightweight plastic pipe such as polyvinyl chloride (PVC).

Figure 3A:
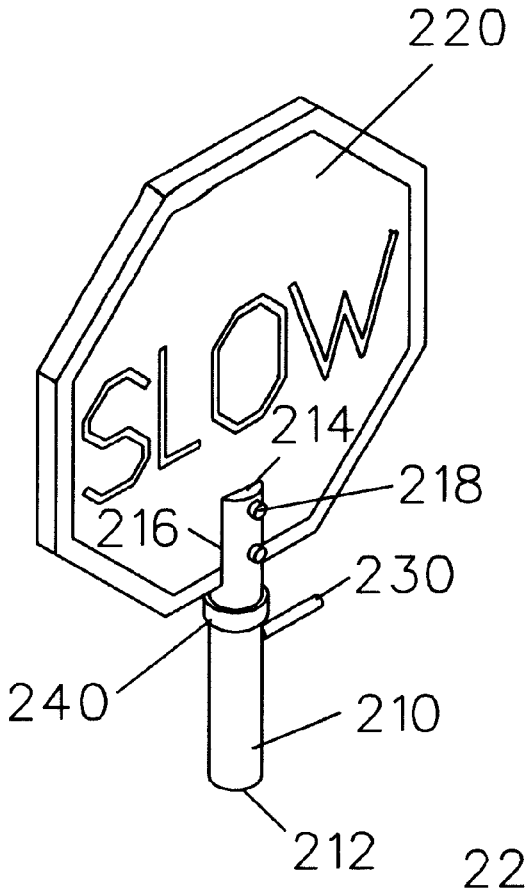
FIGS. 3A, 3B are isometric views of the sign assembly showing first and second rotatable positions of the sign.
Figure 3B:
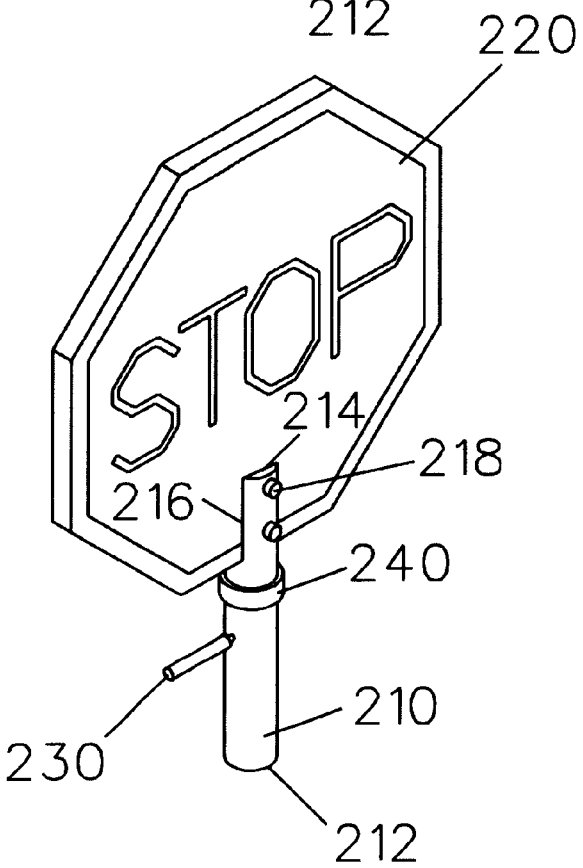

As more particularly shown in FIGS. 3A and 3B, the sign assembly 200 includes a cylindrical shaft 210 having first lower 212 and second upper 214 ends. The second end 214 of the sign assembly shaft 210 includes an upwardly open U-shaped slot 216 for slidably receiving a traffic sign 220 therein, said sign 220 being secured to the sign assembly shaft 210 with bolts 218 threadably extending through apertures in the shaft 210. A handle 230 is normal to the sign assembly shaft 210 and positioned within the same vertical plane as the sign 220 for manually rotating the sign assembly 200 from side to side as to be further described. The sign assembly shaft 210 further includes a threaded coupling 240 slidably mounted between the handle 230 and slot 216 for screwably securing the sign assembly 200 to a first end 112 of the primary shaft 110 having complementary threads 114 thereon (FIGS. 5–6).

Figure 4:
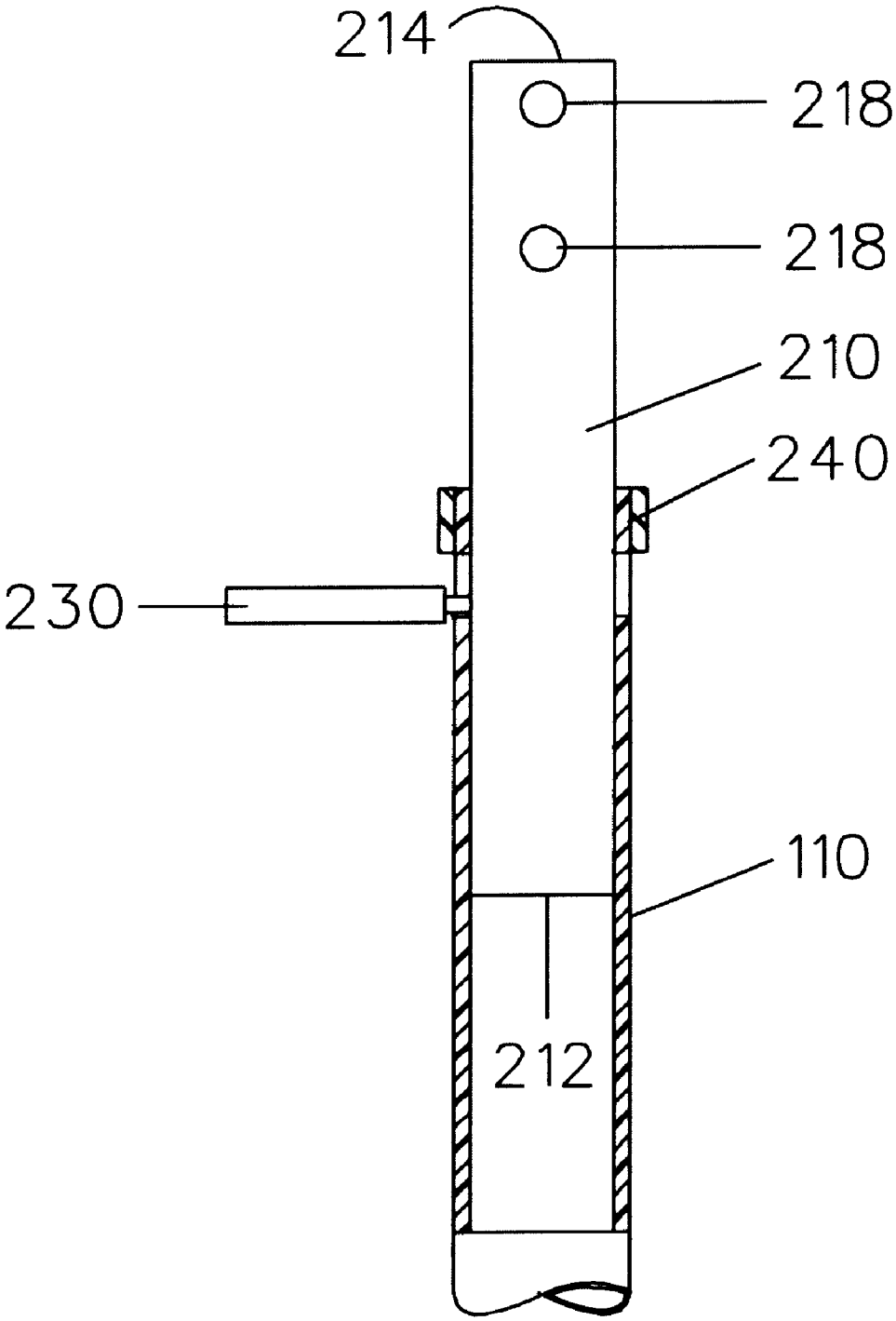
FIG. 4 is a fragmentary sectional view of the primary shaft with the sign inserted therein.
Figure 5:
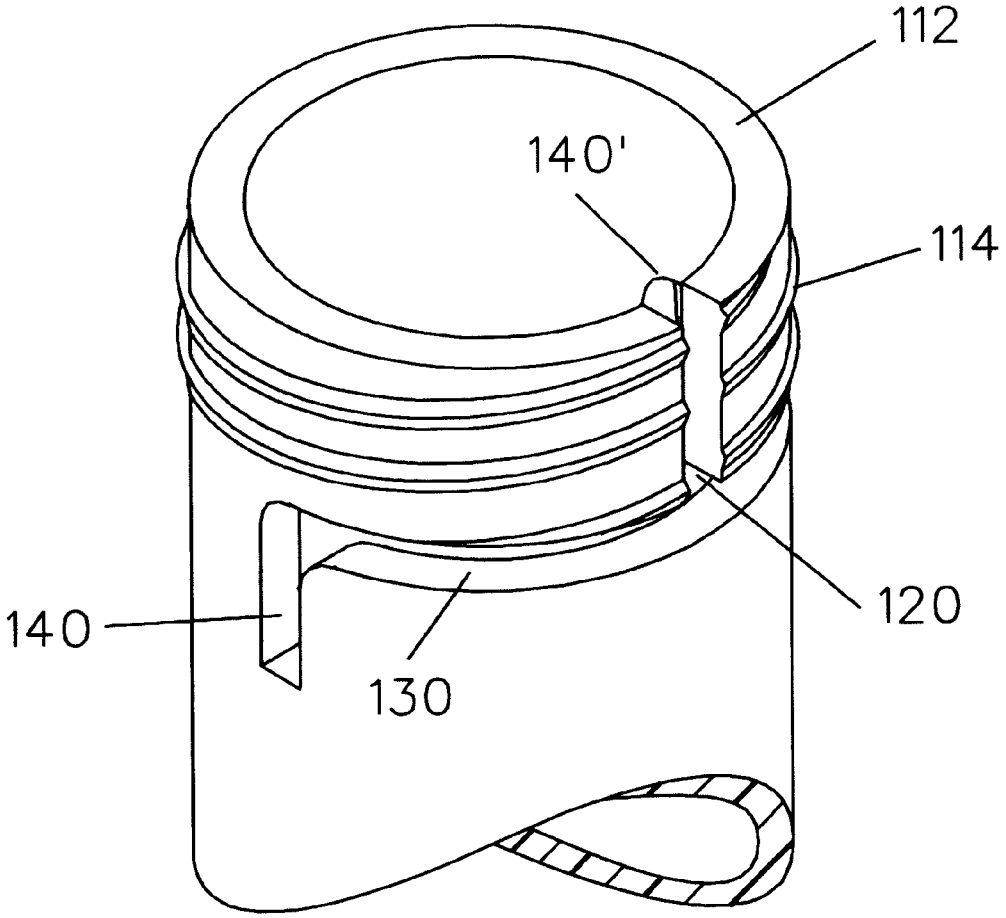
FIG. 5 is a perspective fragmentary view of the top of the shaft on an enlarged scale showing the locking slots and horizontal channel configuration for rotation and locking of a sign assembly within the shaft.
Figure 6:
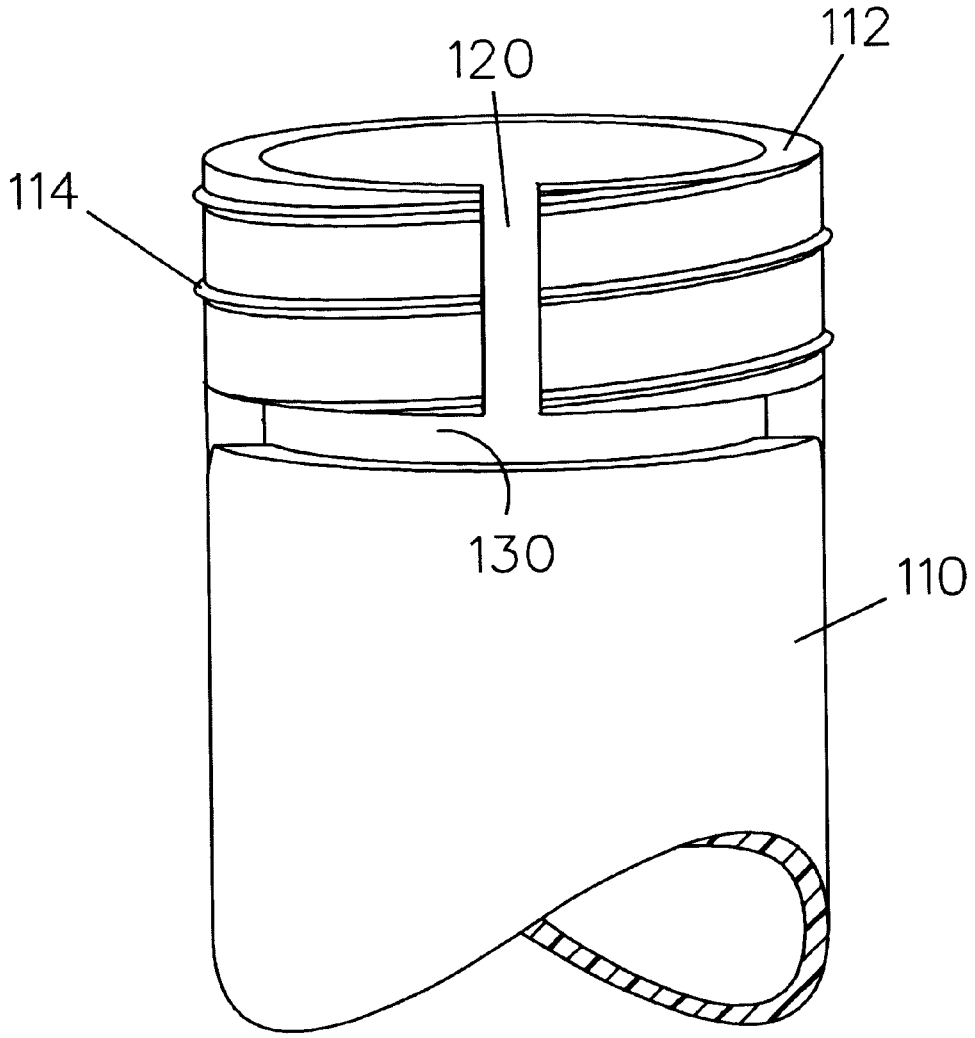
FIG. 6 is a rear fragmentary perspective view of the shaft slots and channel shown in FIG. 5.

As shown in FIGS. 4–6, the primary shaft 110 presents an aperture of a bore having an interior diameter that is larger than the diameter of the sign assembly shaft 210, said primary shaft 110 thereby receiving the sign assembly shaft 210 therein. The primary shaft 110 further includes a vertical slot 120 extending from a first free end 112 of shaft 110 to a horizontal annular channel 130 for receiving the handle 230 of the sign assembly 200 and guiding said handle 230 into said channel 130. The channel 130 annularly extends from the vertical slot 120 in opposing directions about the perimeter of the primary shaft 110 for guiding the handle 230 in opposed directions during manual rotation of the sign assembly 200. The channel 130 extends approximately 180° between depending vertical slots 140, 140' which communicate with the channel 130 at the ends thereof. The slots

140, 140' lockingly receive the handle 230 upon clockwise or counterclockwise 180° rotation of the sign assembly 200. The handle 230 is released from a vertical slot 140, 140' upon a manual upward lifting of the handle 230 by an operator so as to align handle 230 with the juncture of the top of the slot 140, 140' and the respective end of the adjacent channel 130. It is understood that the 180° annular channel 130 facilitates 180° rotation of the traffic sign 220 such that either side of a traffic sign may be displayed to oncoming traffic without repositioning the primary shaft 110. A channel of another length and a different number of depending slots can also be used. For example, a 360° channel with slots at 90° intervals would present a full rotation of the sign lockable at discrete positions positioned at 90° intervals.

A bracket 150 may be releasably attached to shaft 110 to support a strobe light 300, said strobe light 300 having a shroud 310 which directs a high-speed intermittent light beam onto the traffic sign 220 to enhance the readability thereof and to alert distant motorists of a traffic condition. (See FIGS. 1–2.) The strobe light 300 may be powered by a rechargeable battery housed within a battery compartment 320. The strobe light 300 is preferably positioned such that an operator can operate the signaling device 100 from one side of the sign 220 while being shielded from the strobe light 300 by the opposed sign of the sign 220.

Accordingly, it can be seen that the traffic signaling device disclosed herein improves the safety of both motorists and road construction workers, especially during nighttime hours. The traffic signaling device alerts distant motorists to an upcoming traffic condition and then illuminates the traffic sign to enhance its readability. The signaling device allows the operator to rotate the traffic sign 180° without repositioning the primary shaft or strobe light.

It is therefore understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A sign system comprising:

a first shaft having a first ground adjacent end for supporting said first shaft on a ground surface and a second upper end;

a bore within said first shaft presenting an aperture at said upper end of said first shaft;

a channel extending partially around said first shaft in a transverse configuration displaced from said upper end;

a first slot in said first shaft and in communication with said channel, said first slot extending from said channel toward said upper end;

a second slot in said first shaft and in communication with said channel, said second slot spaced from said first slot;

a second shaft having a configuration for insertion within said bore in said first shaft;

a sign atop said second shaft;

a handle extending from said second shaft, said handle slidable in said first slot upon said insertion of said second shaft within said bore in said first shaft, said first slot directing said handle to said channel, said channel providing a course for movement of said handle therealong and a concurrent rotation of said second shaft within said first shaft, said second slot adapted to receive said handle therein for stopping said handle movement in a first direction along said channel whereby to adjust a position of said sign atop said second shaft, said handle protruding outwardly of said first shaft so as to be accessible by a user for manually adjusting the position of said sign.

2. The system as claimed in claim 1 wherein said second slot depends from said channel.

3. The system as claimed in claim 1 further comprising a third slot in said first shaft and in communication with said channel for reception of said handle therein, said third slot spaced from said second slot, said third slot precluding further movement of said handle along said channel in a second direction along said channel opposite said first direction upon said reception of said handle in said third slot.

4. The system as claimed in claim 3 wherein said third slot depends from said channel.

5. The system as claimed in claim 3 wherein said sign comprises first and second opposed surfaces, said second and third slots spaced apart whereby a reception of said handle in said second slot positions said first sign surface in a chosen direction relative to said first shaft, a reception of said handle in said third slot positions said second oppose d sign surface in said chosen direction relative to said first shaft.

6. The system as claimed in claim 1 wherein said first shaft is cylindrical in configuration, said channel annularly extending about said first shaft.

7. The system as claimed in claim 1 further comprising:

a light;

means for mounting said light to said first shaft to illuminate said sign.

8. A sign system comprising:

an elongate first shaft having a first lower end adapted to support said first shaft in a vertical position on a ground surface and a second upper end;

a bore within said first shaft presenting an aperture at said upper end of said first shaft;

a channel extending partially around said first shaft in a transverse configuration displaced from said upper end;

a vertical slot extending between said channel and said upper end;

a pair of spaced-apart slots in said first shaft and in communication with said channel;

a second shaft rotatable within said first shaft;

a sign atop said second shaft;

a handle extending from said second shaft and through said channel upon an insertion of said second shaft within said first shaft, said handle being slidably movable along said channel between said slots for rotating said second shaft and said sign without rotating said first shaft, said slots stopping said slidable movement and rotation upon a reception of said handle therein, said handle protruding outwardly of said first shaft so as to be accessible by a user for manually adjusting a position of said sign.

9. The system as claimed in claim 8 wherein said slots depend from said channel.

10. The system as claimed in claim 8 further comprising a third slot extending between said channel and said upper end of said first shaft, said third slot guiding said handle to said channel upon said insertion of said second shaft within said first shaft.

11. The system as claimed in claim 8 wherein said first shaft is cylindrical in configuration, said pair of spaced slots positioned at distances along said channel corresponding to a desired degree of rotation of said second shaft within said first shaft.

12. The system as claimed in claim 11 wherein, an angle between said slots is 180 degrees.

13. The system as claimed in claim 8 further comprising:

a light;

means for mounting said light to said first shaft to illuminate said sign.

14. A sign system comprising:

a first shaft having a first ground adjacent end for supporting said first shaft in a vertical position on a ground surface and a second end displaced therefrom;

a channel extending partially around said first shaft in a transverse configuration relative to said first shaft;

a vertical slot extending between said channel and said second end;

a second shaft rotatably mounted within said first shaft;

a sign attached to said second shaft;

a handle extending from said second shaft and through said channel, said handle adapted for movement along said channel for rotating said second shaft and said sign attached thereto relative to said first shaft; and a pair of spaced-apart slots in said first shaft and communicating with said channel for reception of said handle therein, said slots precluding further movement of said handle along said channel upon said reception of said handle therein, said handle protruding outwardly of said first shaft so as to be accessible by a user for manually adjusting a position of said sign.

15. The system as claimed in claim 14 wherein said pair of slots are spaced apart at a distance along said channel corresponding to a desired degree of movement of said handle along said channel and rotation of said second shaft and sign attached thereto.

16. A sign system comprising:

a first cylindrical shaft having a first ground adjacent end for supporting said first shaft in a vertical position upon a ground surface and a second upper end;

a bore within said first shaft presenting an aperture at said upper end of said first shaft;

a channel extending partially around said first cylindrical shaft;

a first slot in said first shaft and in communication with said channel, said first slot extending from said channel toward said upper end;

a second shaft having a configuration for insertion within said bore in said first shaft;

a sign atop said second shaft;

a handle extending from said second shaft, said handle slidable in said first slot upon said insertion of said shaft within said bore in said first shaft, said first slot directing said handle to said channel, said handle adapted for a user movement along said channel for rotation of said second shaft within said first shaft, whereby to adjust a position of said sign atop said second shaft, said handle protruding outwardly of said first shaft so as to be accessible by a user for manually adjusting the position of said sign.

17. The sign system as claimed in claim 16, wherein said handle is positioned within a same vertical plane as said sign.

* * * * *